US008247155B2

(12) United States Patent
Lai et al.

(10) Patent No.: US 8,247,155 B2
(45) Date of Patent: Aug. 21, 2012

(54) PRODUCTION OF TONER FOR USE IN PRINTING APPLICATIONS

(75) Inventors: Choung Lai, Doylestown, PA (US); Ronald W. Schuck, Doylestown, PA (US); Charles B. Rybny, Doylestown, PA (US)

(73) Assignee: Penn Color, Inc., Doylestown, PA (US)

( * ) Notice: Subject to any disclaimer, the term of this patent is extended or adjusted under 35 U.S.C. 154(b) by 216 days.

(21) Appl. No.: 12/672,208

(22) PCT Filed: Jan. 15, 2009

(86) PCT No.: PCT/US2009/031109

§ 371 (c)(1),
(2), (4) Date: Feb. 4, 2010

(87) PCT Pub. No.: WO2009/091893

PCT Pub. Date: Jul. 23, 2009

(65) Prior Publication Data

US 2011/0159421 A1 Jun. 30, 2011

Related U.S. Application Data

(60) Provisional application No. 61/021,504, filed on Jan. 16, 2008.

(51) Int. Cl.
*G03G 5/00* (2006.01)

(52) U.S. Cl. ..... 430/137.1; 430/137.14

(58) Field of Classification Search ..... 430/137.1, 430/137.14

See application file for complete search history.

(56) References Cited

U.S. PATENT DOCUMENTS

| | | | |
|---|---|---|---|
| 3,422,049 | A | 1/1969 | McClain |
| 3,432,483 | A | 3/1969 | Peoples et al. |
| 3,449,291 | A | 6/1969 | Lerman et al. |
| 3,468,986 | A | 9/1969 | Watanabe |
| 3,505,434 | A | 4/1970 | Battaerd |
| 3,586,654 | A | 6/1971 | Lerman et al. |
| 3,622,555 | A | 11/1971 | Rothenbury et al. |
| 3,669,922 | A | 6/1972 | Bartsch et al. |
| 3,674,736 | A | 7/1972 | Lerman et al. |
| 3,746,681 | A | 7/1973 | McClain |
| 3,972,865 | A | 8/1976 | McClain et al. |
| 4,027,079 | A | 5/1977 | McClain et al. |
| 4,100,335 | A | 7/1978 | McClain et al. |
| 4,104,453 | A | 8/1978 | Broering et al. |
| 4,148,766 | A | 4/1979 | McClain |
| 4,148,768 | A | 4/1979 | McClain |

(Continued)

*Primary Examiner* — Mark F Huff
*Assistant Examiner* — Stewart Fraser
(74) *Attorney, Agent, or Firm* — Stradley Ronon Stevens & Young, LLP

(57) ABSTRACT

The present invention provides a process for producing a colored toner comprising the steps of: providing a polymer composition comprising at least one polymer wherein the at least one polymer has a softening temperature from about 30° C. to about 160° C.; and a colorant; forming an aqueous mineral suspension of at least one multivalent metal phosphate by contacting a water-soluble salt of the multivalent metal with an aqueous solution comprising: a water-soluble phosphate salt; and at least one crystal growth inhibitor which controls the growth of the at least one multivalent metal phosphate, wherein the pH of the aqueous mineral suspension is from 5.5 to 14; and forming a dispersion of the polymer composition by adding the polymer composition to the aqueous mineral suspension under agitation to form a solid portion comprising dispersed particles of the polymer composition, wherein the temperature of the aqueous mineral suspension during the dispersing step is at least about 70° C.

26 Claims, 1 Drawing Sheet

U.S. PATENT DOCUMENTS 4,150,003 A 4/1979 McClain et al.
4,151,133 A 4/1979 McClain
4,200,601 A 4/1980 McClain
4,208,528 A 6/1980 McClain
4,212,966 A 7/1980 McClain
4,252,969 A 2/1981 Broering et al.
4,254,207 A 3/1981 Landoll et al.
4,267,310 A 5/1981 Landoll
4,287,333 A 9/1981 McClain
4,329,304 A 5/1982 McClain
4,329,305 A 5/1982 McClain
4,336,210 A 6/1982 McClain
4,403,068 A 9/1983 McClain
4,440,908 A 4/1984 McClain
4,610,944 A 9/1986 Matsumoto et al.
4,833,060 A 5/1989 Nair et al.
4,863,646 A 9/1989 Watanabe et al.
5,185,229 A 2/1993 Sato et al.
5,283,150 A 2/1994 Tyagi et al.
5,300,386 A 4/1994 Kanbayashi et al.
5,418,108 A 5/1995 Kmiecik-Lawrynowicz et al.
5,472,649 A 12/1995 Chang et al.
5,529,876 A 6/1996 Sasaki et al.
5,556,732 A 9/1996 Chow
5,658,704 A 8/1997 Patel et al.
5,763,130 A 6/1998 Sasaki et al.
5,780,196 A 7/1998 Fujiwara et al.
5,843,614 A 12/1998 Shinzo et al.
6,054,244 A 4/2000 Kato et al.
6,287,742 B1 9/2001 Yoon
6,340,549 B1 1/2002 Maehata et al.
6,436,599 B1 8/2002 Matsuoka et al.
6,531,255 B2 3/2003 Kim et al.
6,558,864 B2 5/2003 Ishiyama et al.
6,582,867 B2 6/2003 Daimon et al.
6,821,703 B2 11/2004 Uno et al.
6,864,029 B2 3/2005 Hamano et al.
7,074,541 B2 7/2006 Yamashita et al.
7,241,548 B2 7/2007 Sugiyama et al.
2006/0046178 A1 3/2006 Akiyama et al.
2006/0099529 A1 5/2006 Tanaka et al.
2006/0216627 A1 9/2006 Mizutani et al.
2006/0292476 A1* 12/2006 Maehata et al. ..... 430/109.4
2006/0292479 A1 12/2006 Burkum
2007/0042286 A1* 2/2007 Vanbesien et al. ..... 430/137.14
2007/0065746 A1* 3/2007 Kawase et al. ..... 430/110.3
2007/0092821 A1 4/2007 Sato et al.
2007/0128537 A1* 6/2007 Ariyoshi et al. ..... 430/137.1
2007/0148576 A1 6/2007 Ishiyama et al.
2007/0202433 A1 8/2007 Matsumoto et al.
2007/0275316 A1* 11/2007 Ishikawa et al. ..... 430/108.3

* cited by examiner

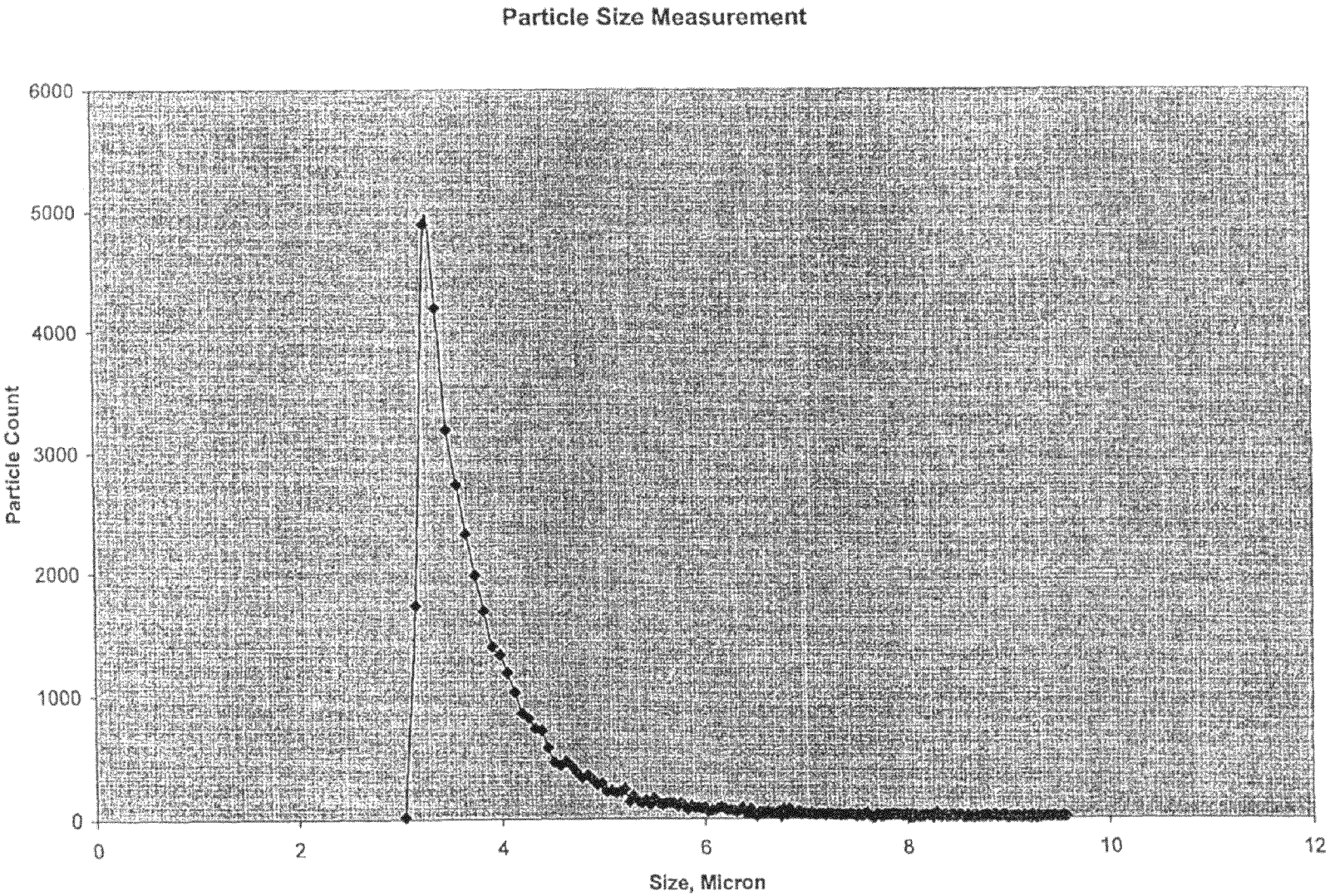
Particle Size Measurement
Particle Count
6000
5000
4000
3000
2000
1000
0
0
2
4
6
8
10
12
Size, Micron

PRODUCTION OF TONER FOR USE IN PRINTING APPLICATIONS

BACKGROUND OF THE INVENTION

This invention relates to a process for producing a colored toner to be used in electrophotography, electrostatic recording, electrostatic printing or toner-jet recording printing operations. More particularly, the invention provides a melt-dispersion process for producing a colored toner wherein the toner comprises particles of a controlled particle size and a narrow particle size distribution.

Electrophotography is a process that employs a photoconductive material to form an image by forming an electrostatic latent image on a photosensitive member by various means, subsequently developing the electrostatic latent image by the use of a toner to form a toner image, transferring the toner image to a recording medium such as paper as the occasion arises, and thereafter fixing the toner image by the action of heat, pressure or solvent vapor. As methods for developing the electrostatic image by the use of toners or methods for fixing the toner image, a variety of methods have been proposed, and methods suited for the respective image forming processes are employed. In recent years, higher-speed copying, higher image quality and color image formation are required for electrophotography. This has placed a demand in the art for developing colored toners that can perform satisfactorily in such processes.

The toner used in electrophotography applications typically comprises a colorant (which includes the color black) dispersed in a resin having a binding property referred to as a binder resin and, optionally, contains various additives such as a charge controller. In use, the toner is typically charged by triboelectric charging and supplied while being carried on a developing roller or the like to the surface of the photoreceptor.

One method of producing toners is by melt-kneading colorants such as dyes and pigments into thermoplastic resins to effect uniform dispersion, followed by pulverization and classification using a fine grinding mill and a classifier, respectively, to produce toners having the desired particle diameters. According to the pulverization process, an admixture of toner raw materials such as binder resin and a colorant is melt-kneaded, and a melt-kneaded product thus obtained is cooled down to be solidified, followed by pulverization and classification, in a consequence whereof a toner is obtained. The diameter-reduced toner manufactured by the pulverization method contains particles of which shapes are not uniform, and has extremely deteriorated powder flowability. When such a toner is used, the toner is unevenly charged before supplied to an electrostatic latent image, for example, which possibly generates unevenness in density or color of an image being formed.

Other drawbacks of the pulverization process include a limit to the range in which toner materials are selected. For example, colorant-dispersed resin materials must be brittle enough to be pulverizable with ease by means of an economically usable production apparatus. Since the colorant-dispersed resin materials must be made brittle to meet such a requirement, a group of particles having a broad particle size distribution tends to be formed when such a resin material is actually pulverized at a high speed, especially causing a problem that extremely fine particles having been pulverized excessively are included in this group of particles in a relatively large proportion. Such highly brittle materials tend to be further finely pulverized or powdered when used actually for the development in copying machines or the like.

In addition, the resolution, solid-area uniformity and gradation reproducibility of images formed by toners commonly depends on the properties of toners, especially their particle diameter, in a large proportion, where the use of toners with a smaller particle diameter brings about images with higher quality. Accordingly, recently developed printers and high-grade copying machines perform better with toners having a small particle diameter; however, in making toner particles having a smaller particle diameter by the pulverization process, the cost of pulverization would increase exponentially while the classification yield would be reduced precipitously, which makes the conventional production method cost prohibitive.

To overcome problems associated with the pulverization process, various toner production processes have evolved through the years. One method is a suspension polymerization method wherein a monomer mixture, most commonly a mixture of styrene monomer, acrylic monomers, a polymerization initiator, a colorant, and other ingredients are evenly mixed into an organic liquid phase, followed by dispersing the organic liquid phase in aqueous media and polymerizing the organic liquid phase. A significant drawback of this method is that the binder resin is limited to vinylic polymers such as polystyrene-acrylate copolymers, which can be manufactured by radical polymerization. The toner containing the vinylic polymer as binder resin is limited in printing performances such as high speed fusing properties and color chromaticity.

Another method is emulsion agglomeration method wherein a polymer colloid and a pigment colloid are mixed together, then induce the mixture to go through a controlled coagulation to form agglomerated particles to obtain a toner. The drawback of this method is that the binder colloid is limited to polystyrene-acrylate copolymers, and the composition of each toner particle tends to have large variation.

Yet another method is solvent dispersion method wherein a binder resin is dissolved in a water immiscible organic solvent solution containing dispersed colorant and other ingredients, then disperse the organic solution in water with the aid of a dispersant, followed by removal of the organic solvent to obtain a dispersion of toner particles in water, followed by washing and drying. The method allows the use of a broader choice of binder resins including the more desirable polyester resin. However, a significant drawback of this method is the employment of a substantial amount of organic solvent which is environmentally undesirable. Furthermore, it is difficult to completely remove the solvent from the toner particles.

A method that avoids much of the above drawbacks is the melt dispersion process in which a molten mixture comprising binder resin and colorant is dispersed under agitation in water in the presence of a dispersant. The types of dispersants employed in the prior art vary. For example, U.S. Pat. No. 3,669,922 discloses a process that comprises a controlled heating, melting, and dispersion of a polymer in the presence of water and a nonionic surfactant; U.S. Pat. No. 3,422,049 discloses a process that comprises a controlled heating, melting, and dispersion of a polymer in the presence of water and a block copolymer of ethylene oxide and propylene oxide; U.S. Pat. No. 4,440,908 discloses a process that comprises a controlled heating, melting, and dispersion of a polymer in the presence of water and a dispersing amount of a substantially water insoluble ionomer polymer such as, for example, polyethylene; U.S. Pat. No. 4,610,944 discloses a process that comprises a controlled heating, melting, and dispersion of a polymer in the presence of water and fine powdery inorganic particles; and U.S. patent application Publication No. 2007/0202433 discloses a process of manufacturing a toner comprising granulating by applying a shearing force and a collision force to a kneaded product of toner raw material containing binder resin and a colorant in water under heat and pressure and in the presence of a water-soluble polymer dispersant such as, for example, one or more water-soluble polymeric dispersants selected from polyoxyalkylene alkylarylether sulfate salt and polyoxyalkylene alkylether sulfate salt. In such prior art methods, however, it is difficult to achieve particle sizes below 12 μm with a narrow size distribution, which are needed to achieve the printing definition and resolution demanded by the current state of the art of printers and copiers. Moreover, the process described in U.S. patent application Publication No. 2007/0202433 employs a large amount of water-soluble polymeric dispersant which is often difficult to remove in the final product even by a subsequent washing process, thus, charge characteristics of the toner particles vary widely with the residual level and the type of the dispersants used. Accordingly there is a need in the art for a process for producing toner that does not suffer from the drawbacks associated with the prior art processes.

BRIEF SUMMARY OF THE INVENTION

The present invention provides a melt dispersion process for producing a colored toner having a volume average particle size preferably below 12 μm, and a particle size distribution of less than 1.4 such that the resultant toner is effective to achieve the printing definition and resolution demanded by the current state of the art of printers and copiers. Water-soluble dispersants and organic solvents are not employed in the method of the present invention. The particle size distribution as stated herein is a ratio of the volume average particle size (Pv) and number average particle size (Pn) of the toner particles. A ratio Pv/Pn=1 indicates an ideal mono-particle size distribution.

Accordingly, in one aspect the present invention provides a process for producing a colored toner comprising the steps of: providing a polymer composition comprising at least one polymer wherein the at least one polymer has a softening temperature from about 30° C. to about 160° C.; and a colorant; forming an aqueous mineral suspension of at least one multivalent metal phosphate by adding a water-soluble salt of the multivalent metal into an aqueous solution comprising: (1) a water-soluble phosphate salt; and (2) at least one crystal growth inhibitor selected from the group consisting of: an organic polycarboxylic acid or a salt there of, a pyrophosphate salt, phosphonic acid or a salt thereof, citric acid, L-Serine, 1,2-dihydroxy-1,2-bis(dihydroxyphosphonyl) ethane, and a $Zn^{2+}$ salt, to precipitate the at least one multivalent metal phosphate, wherein the pH of the resultant aqueous mineral suspension is from 5.5 to 14; forming a dispersion of the polymer composition by adding the polymer composition to the aqueous mineral suspension under agitation to form a solid portion comprising dispersed particles of the polymer composition, wherein the temperature of the aqueous mineral suspension during the dispersing step is at least about 70° C.; cooling the aqueous mineral suspension comprising the dispersed particles of the polymer composition to a temperature of from about 1° C. to about 89° C.; washing the particles; and recovering the particles.

In another aspect, the present invention provides a process for producing a colored toner comprising the steps of: providing a polymer composition comprising at least one polyester polymer having a softening temperature from about 30° C. to about 160° C.; and a colorant; forming an aqueous mineral suspension of at least one of a calcium phosphate and a magnesium phosphate by adding a water soluble salt of at least one of calcium or magnesium into an aqueous solution comprising: a water soluble phosphate salt; and at least one crystal growth inhibitor selected from the group consisting of: an organic polycarboxylic acid or a salt there of, a pyrophosphate salt, phosphonic acid or a salt thereof, citric acid, L-Serine, 1,2-dihydroxy-1,2-bis(dihydroxyphosphonyl) ethane, and a $Zn^{2+}$ salt, to precipitate the at least one of a calcium phosphate and a magnesium phosphate, wherein the pH of the aqueous mineral suspension is from 7 to 12; heating the at least one multivalent metal phosphate at a temperature of from about 90° C. to about 100° C. for from about 10 to about 20 minutes; dispersing the polymer composition by adding the polymer composition to the aqueous mineral suspension under agitation to form a solid portion comprising dispersed particles of the polymer composition, wherein the temperature of the aqueous mineral suspension during the dispersing step is at least about 70° C.; cooling the aqueous mineral suspension comprising the dispersed particles of the polymer composition to a temperature of from about 1° C. to about 89° C.; washing the particles; and recovering the particles, wherein the volume average particle size of the particles is less than 12 μm, and particle size distribution is less than 1.4.

BRIEF DESCRIPTION OF SEVERAL VIEWS OF THE DRAWINGS

FIG. 1 is a graph illustrating a particle size measurement of toner particles produced according to an embodiment of the present invention.

DETAILED DESCRIPTION OF THE INVENTION

Providing the Polymer Composition (Melt Kneading)

The process of the present invention includes the step of providing a polymer composition comprising at least one polymer (also referred to herein as a "binder resin") wherein the at least one polymer has a softening temperature from about 30° C. to about 160° C.; and a colorant. In preferred embodiments, this includes a melt kneading step to form a polymer composition comprising at least a binder resin (i.e., polymer) and a colorant. The binder resin and the colorant (and other components if present) are melt kneaded to prepare a kneaded resin product. The melt kneading is kneading conducted substantially without the use of an organic solvent, however, small amounts of an organic liquid (including an organic solvent) may be present as a process aid to, for example, control dusting of the polymer. The kneaded polymer composition may optionally contain additives, for example, a releasing agent such as wax and an additive such as a charge controller. The additives are kneaded together with the binder resin and the colorant and dispersed in the kneaded polymer composition.

(a) Binder Resin

As the binder resin, the selection of ingredients is not particularly limited as long as the ingredient can be melt dispersed in its molten state. Examples of suitable binder resins include polyester, acrylic resin, a styrene-acrylic acid copolymer resin, polyurethane, and epoxy resin. Optionally, the binder resin can be modified to contain a small amount of gel content.

Suitable polyesters include a polycondensation of a polybasic acid and a polyhydric alcohol. Suitable polybasic acids include aromatic carboxylic acids, and aliphatic carboxylic acids. Suitable aromatic carboxylic acids include aromatic dicarboxylic acids such as an aromatic dicarboxylic acid, for example, terephthalic acid, isophathalic acid, or naphthalene dicarboxylic acid, and acid anhydride (for example, phthalic acid anhydride) or esterification product thereof, and tri- or higher basic aromatic carboxylic acids, for example, a tri- or higher basic aromatic carboxylic acid such as trimellitic acid (benzene-1,2,4-tricarboxylic acid), trimesinic acid (benzene-1,3,5-tricarboxylic acid), naphthalene-1,2,4-tricarboxylic acid, naphthalene-2,5,7-tricarboxylic acid, or pyrromellitic acid (benzene-1,2,4,5-tetracarboxylic acid), and acid anhydride (for example, trimellitic acid anhydride) or esterification product thereof. Aliphatic carboxylic acids include aliphatic dicarboxylic acids such as an aliphatic dicarboxylic acid, for example, maleic acid, fumaric acid, succinic acid, or adipic acid, and acids anhydride (for example, maleic acid anhydride and alkenyl succinic acid anhydride), or esterification product thereof. The alkenyl succinic acid anhydride comprises various kinds of olefins with addition of maleic acid anhydride, and specific examples thereof include, for example, hexadecenyl succinic acid anhydride, heptadecenyl succinic acid anhydride, octadecenyl succinic acid anhydride, tetrapropenyl succinic acid anhydride, dodecenyl succinic acid anhydride, triisobuteny succinic acid anhydride, or 1-methyl-2-pentedecenyl succinic acid anhydride. The polybasic acids can be used each alone, or two or more of them can be used together. Optionally, the polyesters can be made to contain a small amount of gel content by adding a small amount of multifunctional co-monomers during the polymerization process. In certain embodiments of the present invention, the polyester has a gel content from about 0.1% to 10%.

Suitable polyhydric alcohols include aliphatic polyhydric alcohols and aromatic polyhydric alcohols. The aliphatic polyhydric alcohols include aliphatic diols, such as ethylene glycol, propylene glycol, butane diol, hexane diol, and neopentyl glycol, cycloaliphatic polyhydric alcohols such as cyloalipahtic diols, for example, cyclohexane diol, cyclohexane dimethanol, or hydrogenated bisphenol A, and tri- or higher hydric aliphatic polyhydric alcohols such as glycerine (glycerol), sorbitol, 1,4-sorbitan, 1,2,3,6-hexane tetraol, pentaerythritol, dipentaerythritol, tripentaerythritol, 1,2,4-butane triol, 1,2,5-pentane triol, 2-methylpropane triol, 2-methyl-1,2,4-butane triol, trimethylol ethane, or trimethylol propane. Suitable aromatic polyhydric alcohols include aromatic diols such as bisphenol A or derivatives thereof such as, for example, bisphenol A alkylene oxide adducts such as, for example, bisphenol A ethylene oxide adduct, or bisphenol A propylene oxide adduct, and tri- or higher aromatic polyhydric alcohols such as 1,3,5-trihydroxybenzene. Bisphenol A is 2,2-bis(p-hydroxyphenyl)propane, and the bisphenol A ethylene oxide adduct includes, for example, polyoxyethylene-2,2-bis(4-hydroxyphenyl)propane, and the bisphenol A propylene oxide adduct includes, for example, polyoxypropylene-2,2-bis(4-hydroxyphenyl)propane. The polyhydric alcohols can be used each alone, or two or more of them can be used together.

Polycondensation reaction of polybasic acid and polyhydric alcohol can be effected by methods known to those skilled in the art. For example, the polycondensation reaction can be effected by contacting polybasic acid and polyhydric alcohol each other in the presence or absence of an organic solvent and in the presence of a polycondensation catalyst, and terminated at the instant when the acid value and the softening temperature of the resultant polyester stand at predetermined values. In the case of using the methyl-esterified compound of polybasic acid as a part of polybasic acid, a de-methanol polycondensation reaction takes place. In the polycondensation reaction, by properly changing the blending ratio, the reaction rate, or other factors as to the polybasic acid and the polyhydric alcohol, it is possible to adjust, for example, the terminal carboxyl group content of polyester and thus denature a property of the resultant polyester. Further, in the case of using trimellitic anhydride as polybasic acid, the denatured polyester can be obtained also by facile introduction of a carboxyl group into a main chain of polyester.

Suitable acrylic resins include an acid group-containing acrylic resin. The acid group-containing acrylic resin can be produced, for example, by polymerization of acrylic resin monomers or polymerization of acrylic resin monomer and vinylic monomer with concurrent use of acidic group- or hydrophilic group-containing acrylic resin monomer and/or acidic group- or hydrophilic group-containing vinylic monomer. Suitable acrylic resin monomers include acrylic acid, methacyrlic acid, acrylate monomer such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate or dodecyl acrylate, and methacrylate monomer such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, or dodecyl methacrylate. The acrylic monomer may have a substituent such as, for example, an acrylate ester monomer or methacrylate ester monomer having a hydroxyl group such as hydroxyethyl acrylate or hydroxypropyl methacrylate. The acrylic monomers can be used each alone or two or more of them can be used together. Suitable vinylic monomers include aromatic vinyl monomers such as styrene and α-methylstyrene, aliphatic vinyl monomers such as vinyl bromide, vinyl chloride, or vinyl acetate, and acrylonitrile monomers such as acrylonitrile and methacrylonitrile. The vinylic monomers can be used each alone or two or more of them can be used together. The polymerization is typically effected by use of a commonly-used radical initiator in accordance with a solution polymerization method, a suspension polymerization method, an emulsification polymerization method, or the like method.

Suitable styrene-acrylate copolymer resins include those made by copolymerization of a mixture of styrenic monomers, acrylic monomers, methacrylic monomers, and optionally a small amount of multifunctional monomers to impart gel content, and other co-monomers. Examples of styrenic monomers include styrene, α-methylstyrene, o-methyl styrene, m-methyl styrene, p-methyl styrene, p-methoxystyrene, divinylbenzen; examples of acrylate monomer include acrylic acid, methyl acrylate, ethylacrylate, n-propylacrylate, n-butylacrylate, isobutylacrylate, 2-ethylhexylacrylate, n-octylacrylate, dodecylacrylate, stearylacrylate, hydroxyethylacrylate, hydroxypropylacrylate, ethylenediacrylate, butylenediacrylate, trimethylolpropanetriacrylate. Examples of methacrylate monomers include methacrylic acid, methyl methacrylate, ethyl methacrylate, propyl methacrylate, n-butyl methacrylate, isobutyl methacrylate, octyl methacrylate, 2-ethylhexyl methacrylate, hydroxyethyl methacrylate, hydroxypropyl methacrylate, allyl methacrylate, ethyldimethacrylate, butyldimethacrylate, hexyldimethacrylate.

Suitable polyurethane resins include an acidic group- or basic group-containing polyurethane. The acidic group- or basic group-containing polyurethane can be produced in accordance with any method known in the art, for example, by subjecting acidic group- or basic group-containing diol, polyol, and polyisocyanate to an addition polymerization. Examples of the acidic group- or basic group-containing diol include dimethylol propionic acid and N-methyl diethanol amine. Examples of the polyol include polyether polyol such as polyethylene glycol, and polyester polyol, acryl polyol, and polybutadiene polyol. Examples of the polyisocyanate include tolylene diisocyanate, hexamethylene diisocyanate, and isophorone diisocyanate. These components may be used each alone or two or more of the components may be used in combination.

Suitable epoxy resins include a bisphenol A epoxy resin synthesized from bisphenol A and epichlorohydrin, a phenol novolac epoxy resin synthesized from phenol novolac as a reaction product of phenol and formaldehyde, and epychlorohydrin, and a cresol novolac epoxy resin synthesized from cresol novolac as a reaction product of cresol and formaldehyde and epichlorohydrin. Among them, epoxy resins having acidic group or basic group are preferred. An epoxy resin having acidic group or basic group can be prepared, for example, by using the epoxy resin described above as a base and adding or addition polymerizing a polybasic carboxylic acid such as adipic acid or trimellitic acid anhydride, or an amine such as dibutylamine or ethylene diamine to the epoxy resin as the base.

Among these binder resins, a polyester and/or a resin blend that includes a polyester is preferred. Polyesters are typically excellent in transparency and capable of providing toner particles with favorable powder flowability, low-temperature fixing property and secondary color reproducibility. Moreover, resins having a softening temperature of 160° C. or lower, and particularly preferable to use binder resin having a softening temperature of from 60° C. to 160° C. are preferred. As used herein, the term "softening temperature" refers to the temperature at which a material transforms a specific amount when measuring it under specific examination conditions. For example, a standard test know to those skilled in the art and preferred for measuring softening temperature in accordance with the present invention employs a Shimatsu Flowtester CFT-500 (Shimatsu Corporation, Kyoto, Japan) wherein the softening temperature of a polymer is identified as the temperature at which 4 millimeters of the sample flows out of a nozzle. Exemplary examination conditions of the Shimatsu Flowtester CFT-500 instrument are: nozzle size=1 mm in diameter by 10 mm in length; plunger=1 $cm^2$; load=30 Kgf; heating rate=3° C./minute; and sample size=1 gram. Among such binder resins, preferred is a binder resin of which weight-average molecular weight falls in a range of from 5,000 g/mol to 500,000 g/mol. The binder resins may be used each alone or two or more of the binder resins may be used in combination. Furthermore, it is possible to use a plurality of resins of the same type, which are different in any one or all of molecular weight, monomer composition, and other factors.

(b) Colorant

Suitable colorants to be mixed with the binder resin include any of the organic dyes, organic pigments, inorganic dyes and inorganic pigments that are typically used as colorants in toner applications. Examples of such colorants include the following colorants of respective colors to be shown below. In the following, the designation "C. I." means color index.

A black colorant includes, for example, carbon black, copper oxide, manganese dioxide, aniline black, activated carbon, non-magnetic ferrite, magnetic ferrite, and magnetite.

A yellow pigment includes, for example, C.I. pigment yellow 13, C. I. pigment yellow 14, C. I. pigment yellow 17, C. I. pigment yellow 74, C. I. pigment yellow 93, C. I. pigment yellow 155, C. I. pigment yellow 180, and C. I. pigment yellow 185.

An orange colorant includes, for example, red chrome yellow, molybdenum orange, permanent orange GTR, pyrazolone orange, vulcan orange, indathrene brilliant orange RK, benzidine orange G, indathrene brilliant orange GK, C.I. pigment orange 31, C. I. pigment orange 43.

A red colorant includes, for example, C.I. pigment red 52, C.I. pigment red 53, C. I. pigment violet 19, C.I. pigment red 48:1, C.I. pigment red 48:2, C. I. pigment red 48:3, C. I. pigment red 57:1, C. I. pigment red 122, C. I. pigment red 150, and C. I. pigment red 184.

A purple colorant includes, for example, C.I. pigment violet 23, manganese purple, fast violet B, and methyl violet lake.

A blue colorant includes, for example, C. I. pigment blue 15, C. I. pigment blue 15:2, C. I. pigment blue 15:3, C.I. pigment blue 15:4, C. I. pigment blue 16, and C. I. pigment blue 60.

A green colorant includes, for example, chromium green, chromium oxide, pigment green B, micalite green lake, final yellow green G, and C. I. pigment green 7.

A white colorant includes compound, for example, zinc powder, titanium dioxide, antimony white, and zinc sulfide.

The colorants can be used each alone or two or more of them of different colors can be used together. A plurality of colorants of an identical color system can also be used together. The ratio of the colorant used to the binder resin is not particularly restricted and can be properly selected within a wide range in accordance with various conditions such as the type of binder resin and the colorant, the characteristics required for the toner particles to be obtained. As an example, the ratio of the colorant used to the binder resin can be preferably from 0.1 part by weight or 20 parts by weight or less, and more preferably, 5 parts by weight or more and 15 parts by weight or less based on 100 parts by weight of the binder resin.

(c) Additives

The polymer resin composition may optionally further include in addition to the binder resin and the colorant, additives that are typically employed in toners such as, for example, a releasing agent such as a wax and a charge controller. Although optional, the polymer resin preferably includes the wax. Suitable waxes include, for example, natural waxes such as carnauba wax and rice wax, synthetic waxes such as polypropylene wax, polyethylene wax, and Fischer-Tropsch wax, coal type waxes such as montan wax, petroleum waxes such as paraffin wax, alcohol type waxes, and ester type waxes. Such waxes can be used each alone or two or more of them can be used together.

Preferably, the melting point of the wax is between from about 60° C. to about 140° C. and, more preferably, between about 70° C. and about 120° C. By the use of the wax having the melting point in the range described above, the resultant toner typically exhibits excellent anti-hot offsetting and low temperature fixing characteristics. The melting point of the wax is the temperature at the top of a melting peak of a DSC (differential scanning calorimetry) curve.

Although the amount of the wax to be used is not particularly restricted and can be selected properly from a wide range in accordance with various conditions such as the kind of the binder resin, the colorant, the chemistry of the wax, and the characteristics required for the toner particles to be obtained, it is preferably between 5 and 10 parts by weight based on 100 parts by weight of the binder resin.

The charge controller can be any agent that is typically employed in the art as a charge controller such as, for example, calyx arenas, quaternary ammonium salt compounds, nigrosine compounds, organic metal complexes, chelate compounds, metal salts of salicylic acid such as zinc salicylate, and polymeric compounds obtained by homopolymerization or copolymerization of monomers having ionic groups such as sulfonic groups and amino groups. Such charge controllers may be used each alone or two or more of them may be used together. Although the amount of the charge controller is not particularly restricted and can be selected properly from a wide range in accordance with various conditions such as the kind of the binder resin, and the kind and the content of the colorant, it is preferably between from 0.5 to 5 parts by weight based on 100 parts by weight of the binder resin.

The polymer composition can be manufactured, for example, by dry mixing an appropriate amount of each of the binder resin and the colorant and, optionally, an appropriate amount of various kinds of additives such as the wax in a mixer, and melt kneading them by heating to a temperature higher than the softening temperature of the resin, preferably, a temperature higher than the softening temperature and lower than the heat decomposition temperature of the resin, specifically, about at a temperature, preferably, of between about 80 to about 200° C., more preferably, between about 100° C. and about 150° C. In this embodiment, the melt kneading is conducted substantially in the absence of an organic solvent (except for, as mentioned above, wherein small quantities of an organic liquid is employed as a process aid).

Any suitable mixer can be employed for the dry mixing such as, for example, a Henschel mixing apparatus (available from Henschel Industrietechnik GmbH). The kneading can be accomplished by any kneading apparatus typically employed in the art such as, for example, a single or twin screw extruder such as, for example, ZSE18 (manufactured by American Leistritz, Summerville, N.J.), ZSK-30 (trade name of products manufactured by Coperion Wener Pfleiderer GmbH, Stuttgart, Germany), and TSK-TT 020 (manufactured by Theysohn Extruder-Komponenten Salzgitter GmbH) and two roll mills such as Polymill (manufactured by Farrel Corporation, Ansonia, Conn.), and open roll kneading machines such as Kneadex (trade name of products manufactured by Mitsui Mining Co.) and thermoplastic dough kneading such as IP5 AP/T (trade name product manufactured by B&P Process Equipment. The dry kneading may also be conducted by using a plurality of kneading machines.

Forming an Aqueous Mineral Suspension

In the process of the present invention, the melt-dispersion is carried out in an aqueous medium containing a substantially water-insoluble phosphate salt of a multivalent metal (herein also referred to as the "phosphate dispersant"). As used herein the term "multivalent metal" refers to a metal ion having at least two empty electronic valences such as, for example, $Ca^{2+}$, $Mg^{2+}$, and $Al^{3+}$. As used herein, the term "substantially water-insoluble" means that the dispersant has a solubility in water that is less than 1 gram per 100 grams of water. As such, the phosphate dispersant used in the present invention is preferably a particulate matter. The phosphate dispersant functions to disperse the molten polymer composition in the aqueous medium. Suitable phosphate dispersants include calcium phosphate, hydroxylapatite, magnesium phosphate, aluminum phosphate, zinc phosphate, and mixtures thereof. Calcium and/or magnesium phosphates are the preferred phosphate dispersants.

The phosphate dispersant may be used in an amount adapted for giving a desired particle size and distribution selected from the range of from 0.01 to 30 parts, preferably 0.05 to 10 parts, per 100 parts of the polymer composition.

Without intending to be bound by any particular theory, it is believed that such dispersants prevent polymer particles from agglomerating during the melt dispersion process which are present in the form of droplets dispersed uniformly in the aqueous medium and further adsorb uniformly on the surfaces of these droplets to make the droplets stable. Because the size of the water-insoluble dispersant has a proportional effect on the size of particle of the dispersed polymer composition, it is preferred that the phosphate dispersant is formed in situ, to form smaller particles of the phosphate dispersant. Moreover, it is believed that phosphate dispersants formed at higher temperature are of larger size than those formed at lower temperature, and those formed at lower temperatures are inclined to grow in size upon heating. Thus, for temperatures typically experienced during a melt-dispersion operation, it has been difficult to control the volume average particle size of the dispersed polymer composition to below 12 microns using phosphate dispersants formed at a pH of between 5.5 and 14. The present inventors have surprisingly discovered that, by adding a small amount of crystal growth inhibitor to the aqueous media during the preparation of the aqueous mineral suspension of the multivalent metal phosphate, the resultant phosphate dispersants are able to disperse a molten polymer composition consistently into polymer particles of less than 12 microns with a narrow particle size distribution. As used herein, the term "crystal growth inhibitor" refers to a compound that inhibits the particle size growth rate of the phosphate dispersant; such term is not intended to be limited to inhibiting the growth of "crystal" forms of the phosphate dispersants only, but also includes amorphous forms of the phosphate dispersant. Without intending to be bound by a particular theory, it is speculated that, in addition to inhibiting the particle size growth of the phosphate dispersants, the "crystal growth inhibitor" may also influence the chemical composition and the crystal structure (i.e., the crystal shape) of the phosphate dispersant which may, in turn, assist in optimizing its effectiveness as a dispersant of the molten polymer composition and, hence, the size of the toner particles.

Suitable crystal growth inhibitors include, but are not limited to, an organic polycarboxylic acid, a pyrophosphate salt, phosphonic acid or a salt thereof, citric acid, L-Serine, 1,2-dihydroxy-1,2-bis(dihydroxyphosphonyl)ethane, and a $Zn^{2+}$ salt. Examples of suitable organic polycarboxylic acids include phthalic acid, isophthalic acid, terephthalic acid, melitic acid, citric acid, anhydrides, polyacrylic acid, and salts thereof. Examples of suitable $Zn^{2+}$ salts include zinc sulfate, zinc acetate, and zinc chloride. Preferred crystal growth inhibitors are the organic polycarboxylic acids such as phthalic acid, melitic acid, citric acid, and anhydrides thereof, and pyrophosphate salts such as, for example, sodium pyrophosphate and potassium pyrophosphate.

Preferably, the crystal growth inhibitor is present in the aqueous medium in an amount of from about 0.01 to about 200 weigh percent based on the phosphate dispersant, more preferably from about 0.10 to about 100 weigh percent based on the phosphate dispersant, and most preferably from about 1 to about 50 weigh percent based on the phosphate dispersant.

In preferred embodiments of the present invention, the multivalent metal phosphate is formed in situ in an aqueous medium by contacting a water-soluble salt of the multivalent metal with an aqueous solution of a water-soluble phosphate salt and precipitating the at least one multivalent metal phosphate in the presence of at least one crystal growth inhibitor.

Examples of water-soluble salts of the multivalent metal include $CaCl_2$, $MgCl_2$, $FeCl_2$, $AlCl_3$, $ZnCl_2$, $BaCl_2$, $ZnSO_4$, $BaSO_4$, $MgSO_4$, $FeCl_3$, and mixtures thereof.

Examples of water-soluble phosphate salts include $Na_3PO_4$, $Na_3PO_4.12H_2O$, $K_3PO_4$, $NaH_2PO_4$, $Na_2HPO_4$, $KH2PO_4$, $K_2HPO_4$, and mixtures thereof.

Examples of the in situ reaction to produce the substantially water-insoluble phosphate dispersant include:

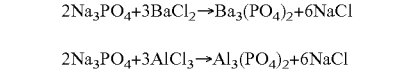

$$2Na_3PO_4+3CaCl_2 \rightarrow Ca_3(PO_4)_2+6NaCl$$

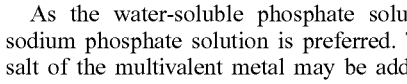

$$2Na_3PO_4+3ZnSO_4 \rightarrow Zn_3(PO_4)_2+3Na_2SO_4$$

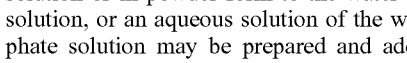

$$2Na_3PO_4+3MgCl_2 \rightarrow Mg_3(PO_4)_2+6NaCl$$

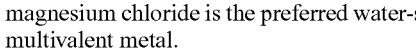

$$2Na_3PO_4+3BaCl_2 \rightarrow Ba_3(PO_4)_2+6NaCl$$

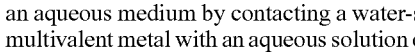

$$2Na_3PO_4+3AlCl_3 \rightarrow Al_3(PO_4)_2+6NaCl$$

As the water-soluble phosphate solution, an aqueous sodium phosphate solution is preferred. The water-soluble salt of the multivalent metal may be added as an aqueous solution or in powder form to the water-soluble phosphate solution, or an aqueous solution of the water-soluble phosphate solution may be prepared and added to the water-soluble salt of the multivalent metal solution. Calcium or magnesium chloride is the preferred water-soluble salt of the multivalent metal.

When the multivalent metal phosphate is formed in situ in an aqueous medium by contacting a water-soluble salt of the multivalent metal with an aqueous solution of a water-soluble phosphate salt in the presence of at least one crystal growth inhibitor, the order of addition is not important. Thus, for example, such precipitation can occur when, for example, the water-soluble salt of the multivalent metal (or a solution thereof) is added to the aqueous solution of a water-soluble phosphate salt and the at least one crystal growth inhibitor or, alternatively, the water-soluble phosphate salt (or a solution thereof) may be added to an aqueous solution of the water-soluble salt of the multivalent metal and the at least one crystal growth inhibitor. In some embodiments of the present invention, the crystal growth inhibitor could also be added to the aqueous medium after the formation of the phosphate crystals.

The pH of the resultant aqueous mineral suspension is preferably from 5.5 to 14, and more preferably from 7 to 12. Additional base may be added to further basify the aqueous mineral suspension, if desired.

In preferred embodiments of the present invention, after it is formed (and prior to the introduction of the polymer melt) the multivalent metal phosphate is heated for a time period of from about 5 to about 60 minutes, more preferably at least from about 10 to about 20 minutes and, most preferably at least for about 15 minutes. During this step the multivalent metal phosphate is preferably heated to a temperature of from at least about 60° C. to about 100° C., more preferably from at least about 80° C. to about 100° C., still more preferably from at least about 90° C. to about 100° C., and most preferably from at least about 95° C. to about 100° C.

In preferred embodiments, the aqueous mineral suspension of at least one multivalent metal phosphate is formed by adding the water soluble salt of the multivalent metal into an aqueous solution of the water-soluble phosphate salt and the at least one crystal growth inhibitor under agitation to precipitate the at least one multivalent metal phosphate. Suitable agitation is provided by, for example, a Kady Lab Mill available from Kady International, Scarborough, Me.)), or a Ross series 100 mixer available from Charles Ross & Son Company, Hauppauge, N.Y.).

Optionally, the aqueous solution comprises a pH control agent. Suitable pH control agents include organic acids such as, for example, acetic acid, propionic acid, butyric acid, and phthalic acid; inorganic acids such as, for example, hydrochloric acid, sulfuric acid, and phosphoric acid; organic bases, such as, for example, ethyl amine, and triethyl amine; and inorganic bases such as, for example, sodium hydroxide, potassium hydroxide, and ammonium hydroxide. A pH control agent according to the present invention can also comprise a buffer.

Once the aqueous mineral suspension of at least one multivalent metal phosphate is formed according to the present invention, the melt dispersion step is performed as described below; however, to obtain an optimal toner, it is preferred that the total amount of the multivalent metal phosphate dispersant is present between about 0.01 to about 30 parts per 100 parts of the polymer composition. In some embodiments of the present invention, the multivalent metal phosphate is employed at a concentration of from about 0.1 to about 30% based on the polymer composition. In other embodiments of the present invention, the multivalent metal phosphate is employed at a concentration of from about 1 to about 15% based on the polymer composition. In yet other embodiments of the present invention, the multivalent metal phosphate is employed at a concentration of from about 2 to about 12% based on the polymer composition. In still other embodiments of the present invention, the multivalent metal phosphate is employed at a concentration of from about 5 to about 8% based on the polymer composition.

Dispersing the Melted Polymer Composition

The polymer composition is next brought into contact with the aqueous mineral suspension as described above and the temperature of the aqueous mineral suspension is increased to a temperature of at least about 70° C., preferably from about 90° C. to about 250° C., and more preferably from 90° C. to about 180° C., depending upon the softening temperature, melting point, melt flow properties, and decomposition temperature of the polymer component(s) of the polymer composition. In one embodiment of the present invention, the polymer composition is added to the aqueous mineral suspension as a dry polymer powder which then becomes molten in the heated aqueous mineral suspension. In another embodiment of the present invention, the polymer composition is in a molten state when it is pumped into the heated aqueous mineral suspension. While the foregoing can be dispersed at temperatures commencing with their respective melting point, increases in dispersion temperature beyond the melting point and up to the decomposition of the resins are generally accompanied by corresponding increases in the fluidity of the molten polymer. As the fluidity of the melt increases, the dispersions generally tend to develop lower average particle sizes without requiring increases in agitation effort.

The dispersing apparatus or device employed to disperse the polymer composition to form toner according to the process of the present invention may be any device capable of delivering at least a moderate amount of shearing action under elevated temperatures and pressures to a liquid mixture. Suitable, for example, are conventional autoclaves equipped with conventional rotor-stator mixers. The particle size and distribution are dependent on the stirring rate, high stirring speeds resulting in finer and narrower dispersions until an optimum speed is reached above which there is little change. In general, the rate of the rotor speed can vary from about 1,200 to about 15,000 rpm and preferably from about 1,800 to about 10,000 rpm. The stirring periods will typically range from about 1 to about 120 minutes and preferably, from about 5 to about 60 minutes. It will be understood, however, that the stirring rates and periods will depend upon the type of equipment utilized.

The amount of water used in relation to the sum total of phosphate dispersant and polymer being dispersed generally ranges from about 0.1 to about 12.0 parts by weight of water per part of total normally solid polymer. Lower ratios, although usable, present operational difficulties. The preferred range is between about 1.0 to about 5.0 parts per part of polymer. The ratio of water to total resin solids typically has an effect on particle size and particle size distribution.

The pressure under which the process of the present invention is carried out is adjusted to exceed the vapor pressure of water at the operating temperature so as to maintain a liquid water phase. More particularly, the pressures may range from about 1 to 217 atmospheres, and preferably from about 1 to 5 atmospheres. In cases where the polymer is sensitive to air at the elevated dispersion temperature, an inert gas, e.g., nitrogen or helium, may be substituted for the air normally present, and deaerated water used. Plasticizers, lubricants, antioxidants, defoamers, and the like can also be included. Mixtures of polymers are also suitable for dispersion in accordance with the process of this invention.

During the melt dispersion step of the present invention, the particle size of the resultant toner is primarily controlled by the amount of the phosphate dispersant (e.g., $Ca_3(PO_4)_2$) and the crystal growth inhibitor in the aqueous mineral suspension.

The foregoing process is advantageously performed substantially without the use of organic solvents.

Cooling Step

In the cooling step, the liquid mixture containing the dispersed solid resin particles (hereinafter also referred to as an aqueous slurry) is cooled. The aqueous slurry is cooled preferably by removing the heat source after forming the dispersion of solid resin particles and by allowing the dispersion to cool either on its own or by employing a coolant such as, for example, ice or an ice bath. The aqueous dispersion is preferably cooled under continuous stirring.

In the dispersion step, since the liquid mixture of the polymer and the aqueous dispersant solution is dispersed by heating the mixture to render the kneaded polymer composition into a molten state, the colorant-containing resin particles just after formation are in a molten state and have tackiness. In preferred embodiments, growth of the particles of the colorant-containing polymer composition does not occur in the cooling step and the colorant-containing resin particles can be cooled while maintaining the size in a state dispersed uniformly in the liquid mixture. Accordingly, a large portion of the solid toner particles in the dispersion will have a particle size of between 2.0 μm to 15.0 μm to give a volume average particle size of the generated toner of a value between about 3.0 μm and about 12 μm and a particle size distribution of less than 1.4.

When the polymer composition is dispersed in a pressurized vessel at a heating temperature of 100° C. or higher it is preferred that pressurization is continued during the cooling step. It is preferred that the pressure in the mixing vessel is returned to atmospheric pressure when the temperature of the mixture in the mixing vessel is below about 50° C. and, more preferably, when the temperature of the mixture in the mixing vessel is about 25° C.

Washing Step

In the washing step, the toner particles dispersed in the aqueous medium are cleaned after cooling to remove any impurities such as, for example, the mineral dispersant particles. Such cleaning is conducted, for example, by employing a combination of water and an acid in an amount sufficient to bring the pH of the dispersion to 3 or below under agitation, followed by rinsing with water alone. Suitable acids include inorganic acids such as, for example, HCl, $HNO_3$, $H_2PO_4$, and mixtures thereof; and organic acids such as, for example, acetic acid, propionic acid, stearic acid, citric acid, and mixtures thereof. After the pH of the dispersion has been lowered to 3 or below, the toner particles are preferably separated from the aqueous medium and washed at least once more with water. Water washing is preferably conducted repetitively till the electroconductivity of the supernatant separated by centrifugation or the like from the liquid mixture lowers to 300 μS/cm or less, preferably, 150 μS/cm or less.

Preferably, the water employed in the water washing is water having an electroconductivity of 50 μS/cm or less. Such water can be prepared, for example, by an activated carbon method, ion exchange method, distillation method or reverse osmosis method. The water washing for the toner resin particles may be conducted either batchwise or continuously. Further, while the temperature of the cleaning water is not particularly restricted, it is preferably from between about 10° C. to about 80° C.

The washing step can be conducted by adding at least one acid to the aqueous medium from the dispersion step or a separation step as described in more detail below can first be performed followed by the washing step.

Separation Step

In the separation step, the toner particles are separated and recovered from the liquid mixture in which they are contained. The toner particles can be separated from the liquid mixture in accordance with a known method and, for example, it can be conducted by filtration, sedimentation, centrifugal separation, etc.

Drying Step

In the drying step, the separated toner particles are dried and optionally classified to obtain the toner particles of the invention. Drying can be conducted in accordance with a known method such as a vacuum oven, a freeze drying method, a spray drying method, a fluid bed, or an air stream drying method.

The resultant toner particles are suitable for use as a toner. Further surface modification of the toner particles can also be conducted, if desired, by externally adding an additive such as, for example, a surface modifier to the toner particles. The surface modifier includes, for example, metal oxide particles such as silica and titanium oxide. Although the ratio of the additive used relative to the toner particles is not particularly restricted, it is preferably employed between about 0.1 to about 10 parts by weight and, more preferably, between about 0.5 and about 5 parts by weight based on 100 parts by weight of the toner particles.

Toner Particle Size

Preferably, the volume average particle size of the particles of the polymer composition obtained by the process of the present invention is less than 12 μm, and particle size distribution is less than 1.4. More preferably, the volume average particle size of the particles of the polymer composition obtained by the process of the present invention is between 3 μm and 12 μm, and particle size distribution is less than 1.4. Still more preferably, the volume average particle size of the particles obtained by the process of the present invention is between about 4.0 μm and about 9.0 μm, and particle size distribution is less than 1.4. As used herein, the distribution is a ratio of the volume average particle size (Pv) and number average particle size (Pn) of the particles. A ratio Pv/Pn=1 indicates an ideal mono-particle size distribution. To generate high quality color images, it is preferred that the $Pv/Pn \leqq 1.4$. The particle size of particles according to the present invention is measured, for example, by a Coulter Particle Counter and Size Analyzer, Model Z2 fitted with a 100 μm orifice aperture tube as described in greater detail below.

The following examples are provided for the purpose of further illustrating the present invention but are by no means intended to limit the same.

EXAMPLES

Toner Particle Size Measurement

The particle size of toner particles can be measured by a Coulter Particle Counter and Size Analyzer, Model Z2 fitted with a 100 μm orifice aperture tube. The instrument allows for particle size measurement with a range of 3× at once, wherein × is the selected lower end of the range to be measured. Thus, two measurements were performed for each sample, one between 3 μm to 9 μm, the other between 9 μm and 27 μm. The raw data of particle counts were imported to a Microsoft Excel™ spreadsheet. The sample vial was shaken in between the two measurements to prevent particle settlement. Volume average particle size (Pv) and number average particle size (Pn) were calculated by the Excel™ spreadsheet. The ratio of Pv/Pn is an indicator of particle size distribution. Pv/Pn=1 indicates an ideal mono-particle size distribution. To generate high quality color images, it is desirable to achieve a particle size distribution of Pv/Pn<1.4.

All slurry samples were filtered through a 45 mm filter before performing the measurement to remove the minute amount of extraneous large particles generated by the process due to imperfection of the mechanical mixing system.

Example 1

With Crystal Growth Inhibitor 425 g of Diacron ER-502 polyester (supplied by Dianal America, Pasadena, Tex.) with a softening temperature of 110° C. and a small amount of gel content, 30 g of pigment blue 15:3, 25 g of bisphenol-A type epoxy resin, and 20 g of Montan wax were mixed in a two-roll mill, and pulverized into 20 mesh coarse powders. The material is designated as Coarse Polymer Powder.

1280 g of de-ionized water was introduced into a 1 gallon vessel fitted with a Kady Lab Mill and stirred at a motor speed of 15 Hz. 17.2 g of trisodium phosphate decahydrate, 2 g of citric acid, and 1 g of sodium pyrophosphate were then added to the vessel. The temperature of the vessel was increased to 98° C. 133 g of 3.5% aqueous solution of calcium chloride was then titrated into the vessel. 10 minutes after completion of the calcium chloride addition, a sample was taken from the vessel and pH of the sample was measured to be 7.8. The motor speed of Kady Mill was then increased to 45 Hz, and 200 g of Coarse Polymer Powder was introduced into the vessel. 30 minutes after introduction of the Coarse Polymer Powder, the vessel was rapidly cooled to 70° C. and the motor speed of Kady Mill was reduced to 20 Hz while cooling continued until the temperature reached 25° C. The resulting slurry was filtered through a 45 μm filter, and the particle size was measured by Coulter Counter Z2. Volume average particle size, Pv, was 6.6 μm. Pv/Pn was 1.32. The resulting fine particle slurry was then washed with hydrochloric acid solution, followed by additional cycles of de-ionized water washing and filtration, and finally was dried to become a Fine Powder. 0.5% of Aerosil R-972 and 0.5% of Aerosil RX50 (Supplied by Degussa, Parsippany, N.J.) based on the Fine Powder was added to the Fine Powder in a Henschel mixer. A color toner was obtained.

Comparative Example 1

The same process of Example 1 was followed, without the addition of citric acid and sodium pyrophosphate. A poor dispersion was obtained with most of the particles having a size of between 50 to 100 μm as observed under a microscope. The particles could not be measured by Coulter Counter because the particle would plug up the orifice of the Aperture Tube.

Example 2

The same process of Example 1 was followed, except that only 1 g of citric acid was added instead of 2 g. pH of a sample retreated 10 minutes after completion of the calcium chloride addition was measured to be 10.5. Pv was 6.9 μm, and Pv/Pn was 1.30.

Example 3

450 g Diacron ER-535 polyester (supplied by Dianal America, Pasadena, Tex.) with a softening temperature of 99° C. with no gel content, 30 g of pigment blue 15:3, 25 g, and 20 g of Montan wax were mixed in a two-roll mill, and pulverized into a 20 mesh coarse powder. The material is designated as Coarse Polymer Powder.

In a 1 gallon vessel fitted with a Kady Lab Mill, 1500 g of de-ionized water was introduced and stirred at a motor speed of 15 Hz. 14.3 g of trisodium phosphate decahydrate and 2 g of phthalic anhydride was then added to the vessel. The temperature of the vessel was increased to 60° C. and 110 g of a 3.5% aqueous solution of calcium chloride was titrated into the vessel. Afterward, the temperature of the vessel was increased to 98° C. and was held at 98° C. for 15 minutes. The motor speed of the Kady Mill was then increased to 45 Hz and 150 g of the Coarse Polymer Powder was introduced into the vessel. 30 minutes after introduction of the Coarse Polymer Powder, the vessel was rapidly cooled to 70° C., the motor speed of Kady Mill was reduced to 20 Hz while cooling continued until the temperature reached 25° C. The resulting slurry was filtered through a 45 μm filter and the particle size was measured by Coulter Counter Z2. Volume average particle size, Pv, was 7.2 Pv/Pn was 1.29. The resulting fine particle slurry was then washed with hydrochloric acid solution, and followed by additional cycles of washing and filtration, and finally was dried to become a Fine Powder. 0.5% of Aerosil R-972 and 0.5% of Aerosil RX50 (Supplied by Degussa, Parsippany, N.J.) based on the Fine Powder was added to the Fine Powder in a Henschel mixer. A color toner was obtained.

Comparative Example 3

450 g Diacron ER-535 polyester (supplied by Dianal America, Pasadena, Tex.) with a softening temperature of 99° C. and no gel content, 30 g of pigment blue 15:3, 25 g, and 20 g of Montan wax were mixed in a two-roll mill, and pulverized into a 20 mesh coarse powder. The material is designated as Coarse Polymer Powder.

1500 g of de-ionized water was introduced into a 1 gallon vessel fitted with a Kady Lab Mill and stirred at a motor speed of 15 Hz. 14.3 g of trisodium phosphate decahydrate was then added to the vessel. The temperature of the vessel was increased to 60° C. and 110 g of 3.5% aqueous solution of calcium chloride was titrated into the vessel. A sample, Calcium Phosphate-1 was retreated from the vessel and the pH was measured to be 11.5. Calcium Phosphate-1 appeared to be a white cloudy liquid and the calcium phosphate particles would settle to the bottom of the sample vial in less than 1 hour. Afterward, 3.5 g of citric acid was added to the vessel and the temperature of the vessel was increased to 98° C. and was held at 98° C. for 15 minutes. A sample, Calcium Phosphate-2, was retreated from the vessel and pH was measured to be 5.5. Calcium Phosphate-2 appeared to be a translucent liquid, and the calcium phosphate particles appeared to be very stable and would not settle after 1 hour of standing in the sample vial. The motor speed of the Kady Mill was increased to 45 Hz and 150 g of Coarse Polymer Powder was introduced into the vessel. A dispersion did not form and the melted polymers fouled the vessel.

It is speculated that the calcium phosphate particles formed at pH<6 carry a different charge polarity or charge density compared with the calcium phosphate formed at pH>7.

Example 4

Magnesium Phosphate 425 g of Diacron ER-502 polyester (supplied by Dianal America, Pasadena, Tex.) with a softening temperature of 110° C. having a small amount of gel content, 30 g of pigment blue 15:3, 25 g of epoxy resin, and 20 g of Montan wax were mixed in a two-roll mill, and pulverized into 20 mesh coarse powders. The material is designated as Coarse Polymer Powder.

1280 g of de-ionized water was introduced into a 1 gallon vessel fitted with a Kady Lab Mill and stirred at a motor speed of 15 Hz. 17.2 g of trisodium phosphate decahydrate and 2 g of citric acid were then added to the vessel. The temperature of the vessel was increased to 98° C. and 133 g of 3.5% aqueous solution of magnesium chloride was titrated into the vessel. 10 minutes after completion of the magnesium chloride addition, a sample was taken from the vessel and pH of the sample was measured to be 7.7. The motor speed of Kady Mill was then increased to 45 Hz, and 160 g of Coarse Polymer Powder was introduced into the vessel. 30 minutes after introduction of the Coarse Polymer Powder, the vessel was rapidly cooled to 70° C. and the motor speed of the Kady Mill was then reduced to 20 Hz while cooling continued until the temperature reached 25° C. The resulting slurry was filtered through a 45 μm filter, and the particle size was measured by Coulter Counter Z2. Because of limitations associated with the Coulter Counter Z2, two measurements were made. The first measurement, which is represented by FIG. 1, was for particles between 2.913 microns and 9.579 microns. The second measurement was for particles between 9.574 microns and 27.08 microns. The raw data was imported to an Excel spreadsheet, and volume average particle size, Pv, and number average particle size, Pn, between 2.913 microns to 15.08 s microns was calculated by the spreadsheet. Volume average particle size, Pv, was 5.7 μm, number average particle size, and Pv/Pn was 1.33. The resulting fine particle slurry was then washed with hydrochloric acid solution, and followed by additional cycles of de-ionized water washing and filtration, and finally was dried to become a Fine Powder. 0.5% of Aerosil R-972 and 0.5% of Aerosil RX50 (Supplied by Degussa, Parsippany, N.J.) based on the Fine Powder was added to the Fine Powder in a Henschel mixer. A color toner was obtained.

Example 5

425 g of Diacron ER-502 polyester (supplied by Dianal America, Pasadena, Tex.) with a softening temperature of 110° C. and a small amount of gel content, 30 g of pigment blue 15:3, 25 g of bisphenol-A type epoxy resin with a molecular weight of 3600, and 20 g of polyolefin wax were mixed in a two-roll mill, and pulverized into 20 mesh coarse powders. The material is designated as "Coarse Polymer Powder."

1280 g of de-ionized water was introduced into a 1 gallon vessel fitted with a Kady Lab Mill and stirred at a motor speed of 15 Hz. 40 g of trisodium phosphate decahydrate, 2 g of citric acid, and 1 g of sodium pyrophosphate were then added to the vessel. The temperature of the vessel was increased to 98° C. 300 g of 3.5% aqueous solution of calcium chloride was then titrated into the vessel. 15 minutes after completion of the calcium chloride addition, a sample was taken from the vessel and the pH of the sample was measured to be 7.8. The motor speed of Kady Mill was then increased to 45 Hz, and 500 g of Coarse Polymer Powder was introduced into the vessel. 35 minutes after introduction of the Coarse Polymer Powder, the vessel was rapidly cooled to 70° C. and the motor speed of Kady Mill was reduced to 20 Hz while cooling continued until the temperature reached 25° C. The particle size of the resulting slurry was measured by a Coulter Counter Z2. The volume average particle size, Pv, was 6.6 μm. The Pv/Pn was 1.27. The resulting fine particle slurry was then washed with hydrochloric acid solution, followed by additional cycles of de-ionized water washing and filtration, and finally was dried to yield a fine powder. 0.5% of Aerosil R-972 and 0.5% of Aerosil RX50 (Supplied by Degussa, Parsippany, N.J.) based on the fine powder was added to the fine powder in a Henschel mixer. A color toner was obtained.

Example 6

The same process of Example 5 was followed, except that only 1 g of citric acid was added instead of 2 g. The pH of a sample retrieved 10 minutes after completion of the calcium chloride addition was measured to be 10.5. The Pv was 6.9 μm, and the Pv/Pn was 1.30.

Example 7

450 g Diacron ER-535 polyester (supplied by Dianal America, Pasadena, Tex.) with a softening temperature of 99° C. with no gel content, 30 g of pigment yellow 74 25 g, and 20 g of polyolefin wax were mixed in a two-roll mill, and pulverized into a 20 mesh coarse powder. The material is designated as Coarse Polymer Powder.

In a 1 gallon vessel fitted with a Kady Lab Mill, 1500 g of de-ionized water was introduced and stirred at a motor speed of 15 Hz. 40 g of trisodium phosphate decahydrate and 2 g of phthalic anhydride was then added to the vessel. The temperature of the vessel was increased to 60° C. and 300 g of a 3.5% aqueous solution of calcium chloride was titrated into the vessel. Afterward, the temperature of the vessel was increased to 98° C. and was held at 98° C. for 15 minutes. The motor speed of the Kady Mill was then increased to 45 Hz and 450 g of the Coarse Polymer Powder was introduced into the vessel. 30 minutes after introduction of the Coarse Polymer Powder, the vessel was rapidly cooled to 70° C., the motor speed of Kady Mill was reduced to 20 Hz while cooling continued until the temperature reached 25° C. The particle size of the resulting slurry was measured by a Coulter Counter Z2. The volume average particle size, Pv, was 7.2 μm. The Pv/Pn was 1.29. The resulting fine particle slurry was then washed with hydrochloric acid solution, and followed by additional cycles of de-ionized water washing and filtration, and finally was dried to yield a fine powder. 0.75% of Aerosil R-972 (Supplied by Degussa, Parsippany, N.J.) based on the fine powder was added to the fine powder in a Henschel mixer. A color toner was obtained.

Comparative Example 4

450 g Diacron ER-535 polyester (supplied by Dianal America, Pasadena, Tex.) with a softening temperature of 99° C. and no gel content, 30 g of pigment blue 15:3, 25 g, and 20 g of polyolefin wax were mixed in a two-roll mill, and pulverized into a 20 mesh coarse powder. The material is designated as Coarse Polymer Powder.

1500 g of de-ionized water was introduced into a 1 gallon vessel fitted with a Kady Lab Mill and stirred at a motor speed of 15 Hz. 40 g of trisodium phosphate decahydrate was then added to the vessel. The temperature of the vessel was increased to 60° C. and 300 g of 3.5% aqueous solution of calcium chloride was titrated into the vessel. A sample, Calcium Phosphate-1 was retrieved from the vessel and the pH was measured to be 11.5. Calcium Phosphate-1 appeared to be a white cloudy liquid and the calcium phosphate particles would settle to the bottom of the sample vial in less than 1 hour. Afterward, 4.0 g of citric acid was added to the vessel and the temperature of the vessel was increased to 98° C. and was held at 98° C. for 15 minutes. A sample, Calcium Phosphate-2, was retrieved from the vessel and the pH was measured to be 5.1. Calcium Phosphate-2 appeared to be a translucent liquid, and the calcium phosphate particles appeared to be very stable and would not settle after 1 hour of standing in the sample vial. The motor speed of the Kady Mill was increased to 45 Hz and 150 g of Coarse Polymer Powder was introduced into the vessel. A dispersion did not form and the melted polymers fouled the vessel.

Without intending to be bound by a particular theory, it is speculated that the calcium phosphate particles formed at pH<6 carry a different charge polarity or charge density compared with the calcium phosphate formed at pH>7.

Example 8

Magnesium Phosphate 425 g of Diacron ER-535 polyester (supplied by Dianal America, Pasadena, Tex.) with a softening temperature of 110° C. having a small amount of gel content, 30 g of pigment red 122, 25 g of epoxy resin, and 20 g of polyolefin wax were mixed in a two-roll mill, and pulverized into 20 mesh coarse powder. The material is designated as Coarse Polymer Powder.

1280 g of de-ionized water was introduced into a 1 gallon vessel fitted with a Kady Lab Mill and stirred at a motor speed of 15 Hz. 40 g of trisodium phosphate decahydrate and 2 g of citric acid were then added to the vessel. The temperature of the vessel was increased to 98° C. and 300 g of 3.5% aqueous solution of magnesium chloride was titrated into the vessel. 10 minutes after completion of the magnesium chloride addition, a sample was taken from the vessel and the pH of the sample was measured to be 7.7. The motor speed of the Kady Mill was then increased to 45 Hz, and 450 g of Coarse Polymer Powder was introduced into the vessel. 30 minutes after introduction of the Coarse Polymer Powder, the vessel was rapidly cooled to 70° C. and the motor speed of the Kady Mill was then reduced to 15 Hz while cooling continued until the temperature reached 25° C.

The particle size of the resulting slurry was measured by a Coulter Counter Z2. Volume average particle size, Pv, was 7.1 μm, and Pv/Pn was 1.30. The resulting fine particle slurry was then washed with hydrochloric acid solution, and followed by additional cycles of de-ionized water washing and filtration, and finally was dried to become a fine powder. 0.75% of Aerosil R-972 (Supplied by Degussa, Parsippany, N.J.) based on the Fine Powder was added to the Fine Powder in a Henschel mixer. A color toner was obtained.

The foregoing examples and description of the preferred embodiments should be taken as illustrating, rather than as limiting the present invention as defined by the claims. As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

The invention claimed is:

1. A process for producing a colored toner comprising the steps of:

providing a polymer composition comprising at least one polymer wherein the at least one polymer has a softening temperature from about 60° C. to about 160° C.; and a colorant;

forming an aqueous mineral suspension of at least one substantially water-insoluble multivalent metal phosphate by contacting a water-soluble salt of the multivalent metal with an aqueous solution comprising:

a water-soluble phosphate salt; and at least one crystal growth inhibitor selected from the group consisting of:

an organic polycarboxylic acid or a salt thereof, a pyrophosphate salt, phosphonic acid or a salt thereof, citric acid, L-Serine, 1,2-dihydroxy-1,2-bis(dihydroxyphosphonyl)ethane, and a $Zn^{2+}$ salt, to precipitate the at least one substantially water-insoluble multivalent metal phosphate, wherein the pH of the aqueous mineral suspension is from 5.5 to 14;

forming a dispersion of the polymer composition by adding the polymer composition to the aqueous mineral suspension under agitation to form a solid portion comprising dispersed particles of the polymer composition, wherein the temperature of the aqueous mineral suspension is at least about 70° C. when the polymer composition is added to the mineral aqueous mineral suspension;

cooling the aqueous mineral suspension comprising the dispersed particles of the polymer composition;

washing the particles; and recovering the particles.

2. The process of claim 1 wherein the volume average particle size of the recovered particles is less than 12 μm, and particle size distribution is less than 1.4.

3. The process of claim 1 wherein the polymer composition further comprises a wax and a charge control agent.

4. The process of claim 1 wherein the metal is at least one of calcium and magnesium.

5. The process of claim 1 wherein the crystal growth inhibitor includes at least the organic polycarboxylic acid and the organic polycarboxylic acid is selected from the group consisting of: phthalic acid, isophthalic acid, terephthalic acid, trimelitic acid, citric acid, anhydrides, polyacrylic acid and salts thereof.

6. The process of claim 1 wherein the at least one polymer includes a polyester.

7. The process of claim 1 wherein the at least one polymer includes a styrene-acrylic copolymer.

8. The process of claim 1 wherein the crystal growth inhibitor is the phosphonic acid or a salt thereof and is selected from the group consisting of: 1-hydroxyethylidene phosphonic acid, 1-hydroxyethylidene diphosphonic acid, and a mixture thereof.

9. The process of claim 1 wherein the washing step includes the step of adding an acid to the aqueous mineral suspension comprising the dispersed particles to bring the pH of the aqueous mineral suspension to less than about 2.

10. The process of claim 9 wherein the washing step further includes separating the solid portion from the aqueous solution and rinsing the solid portion with water.

11. The process of claim 9 wherein the acid is selected from the group consisting of HCl, $HNO_3$, $H_2PO_4$, and mixtures thereof.

12. The process of claim 11 wherein the acid is HCl.

13. The process of claim 1 wherein the recovering step includes capturing the particles in a filter and drying the particles.

14. The process of claim 1 wherein the volume average particle size is between about 4.0 μm and about 9.0 μm.

15. The process of claim 1 wherein the aqueous solution during the step of forming an aqueous mineral suspension is at a temperature of from about 30° C. to about 60° C.

16. The process of claim 1 wherein the aqueous solution further comprises at least one pH control agent selected from the group consisting of: acetic acid, propionic acid, butyric acid, phthalic acid, hydrochloric acid, sulfuric acid, phosphoric acid, ethyl amine, triethyl amine, sodium hydroxide, potassium hydroxide, and ammonium hydroxide.

17. The process of claim 1 wherein the polymer composition further comprises at least one polymer selected from the group consisting of: an epoxy-containing polymer and a polystyrene-acrylate polymer.

18. The process of claim 17 wherein the at least one polymer is the epoxy-containing polymer.

19. The process of claim 17 wherein the at least one polymer is the polystyrene-acrylate polymer.

20. The process of claim 1 wherein the polyester has a weight average molecular weight of from 5,000 g/mol to about 500,000 g/mol.

21. The process of claim 1 wherein the polyester polymer has a gel content greater than 0.1%.

22. The process of claim 1 further comprising the step of heating the at least one multivalent metal phosphate to a temperature of from about 60° C. to about 100° C. for from about 5 to about 60 minutes prior to the step of forming a dispersion of the polymer composition.

23. The process of claim 22 wherein the at least one multivalent metal phosphate is heated at a temperature of from about 90° C. to about 100° C. for from about 10 to about 20 minutes.

24. The process of claim 23 wherein the at least one multivalent metal phosphate is heated at a temperature of from about 95° C. to about 100° C. for about 15 minutes.

25. A process for producing a colored toner comprising the steps of:

providing a polymer composition comprising at least one polyester polymer having a softening temperature from about 60° C. to about 160° C.; and a colorant;

forming an aqueous mineral suspension of at least one of a substantially water-insoluble calcium phosphate and a substantially water-insoluble magnesium phosphate by contacting a water soluble salt of at least one of calcium or magnesium with an aqueous solution comprising:

a water soluble phosphate salt; and at least one crystal growth inhibitor selected from the group consisting of:

an organic polycarboxylic acid or a salt thereof, a pyrophosphate salt, phosphonic acid or a salt thereof, citric acid, L-Serine, 1,2-dihydroxy-1,2-bis(dihydroxyphosphonyl)ethane, and a $Zn^{2+}$ salt, to precipitate the at least one of a substantially water-insoluble calcium phosphate and a substantially water-insoluble magnesium phosphate, wherein the pH of the aqueous mineral suspension is from 7 to 14;

heating the at least one of a substantially water-insoluble calcium phosphate and a substantially water-insoluble magnesium phosphate at a temperature of from about 90° C. to about 100° C. for from about 10 to about 20 minutes;

dispersing the polymer composition by adding the polymer composition to the aqueous mineral suspension under agitation to form a solid portion comprising dispersed particles of the polymer composition, wherein the temperature of the aqueous mineral suspension during the dispersing step is at least about 70° C.;

cooling the aqueous mineral suspension comprising the dispersed particles of the polymer composition;

washing the particles; and recovering the particles, wherein the volume average particle size of the particles is less than 12 μm, and particle size distribution is less than 1.4.

26. The process of claim 1 wherein the at least one polymer includes a polyurethane.

* * * * *